United States Patent [19]

Srour et al.

[11] Patent Number: 4,964,100

[45] Date of Patent: Oct. 16, 1990

[54] ACOUSTIC DETECTION SYSTEM

[75] Inventors: Nassy Srour, Silver Spring, Md.; Michael V. Scanlon, Springfield, Va.

[73] Assignee: The United States of America as Represented by the Secretary of the Army, Washington, D.C.

[21] Appl. No.: 444,335

[22] Filed: Dec. 1, 1989

[51] Int. Cl.[5] ..... H04R 15/00

[52] U.S. Cl. ..... 367/178; 367/191; 181/0.5; 181/177; 381/57; 381/165

[58] Field of Search ..... 181/0.5, 138, 175, 177; 128/653 R, 660.01; 381/124, 165, 153–156, 56, 57, 161, 162, 187, 188; 367/178, 197, 198, 191, 910

[56] References Cited

U.S. PATENT DOCUMENTS

| | | | |
|---|---|---|---|
| 3,305,043 | 2/1967 | Pfund et al. | 181/0.5 |
| 3,425,430 | 2/1969 | Horton | 137/81.5 |
| 4,512,371 | 4/1985 | Drzewiecki et al. | 137/828 |
| 4,689,827 | 8/1987 | Gurney, Jr. | 455/614 |
| 4,850,023 | 7/1989 | Yarush | 381/67 |

FOREIGN PATENT DOCUMENTS

| | | | |
|---|---|---|---|
| 2027318 | 2/1980 | United Kingdom | 367/910 |

OTHER PUBLICATIONS

T. M. Drzewiecki, "A Fluidic Audio Intercom", 1980.
Jane's Defense Weekly, p. 116, 28 Jan. 1989.
Nassy Srour, "Isopads", may 1989.
HDL Pamphlet, "New Acoustic Detection System Developed", Jul. 1989.
Harry Diamond Labs, "Scope", pp. 6 & 7, Sep. 1989.
Washington Technology Magazine; p. 24, Oct. 12, 1989.

*Primary Examiner*—Brian S. Steinberger
*Attorney, Agent, or Firm*—Saul Elbaum; Paul S. Clohan

[57] ABSTRACT

An acoustic detection device having a parabolic dish antenna for gathering sound waves and providing a first stage of amplification, an exponential horn located at the focus of the parabolic dish antenna for further acoustic amplification, a fluidic gainblock for a final stage of amplification, and acoustic earphones for listening. Either a hand operated latex bulb or a mechanical pump is used to pressurize a plastic fluid storage container that is used to supply fluid to the fluidic gainblock. Within the fluidic gainblock are four or more staged laminar proportional amplifiers having a bandwidth of 0 to 4,000 Hz.

17 Claims, 2 Drawing Sheets

ACOUSTIC DETECTION SYSTEM

RIGHTS OF THE GOVERNMENT

The invention described herein may be manufactured, used and licensed by or for the United States Government for Governmental purposes without payment to us of any royalty thereon.

BACKGROUND OF THE INVENTION

The present invention relates to listening devices generally and more particularly to a listening device which amplifies sounds non-electronically using a combination of acoustics and fluidics. Devices for detecting sound at a distance are generally well known. Usually these devices gather and focus the incoming sound waves by the use of a parabolic reflector. A microphone is then placed at the focal point of the parabolic reflector to convert the incoming sound waves to an electrical signal. This signal is then amplified electronically and fed to a set of earphones. While this type of system works fairly well, it has several serious drawbacks. Because it relies on electronics, electronic noise is present which makes the detection of very low sound levels (amplitudes) nearly impossible. This type of system also requires batteries to power the electronics, which makes the system heavy and less portable. It is also difficult to detect low frequency sound with an electronic system, and an electronic system is vulnerable to electronic counter measures (ECM) and thus not particularly suitable to military applications. In addition to ECM vulnerability, an electronic system potentially emits an electronic and thermal "signature" which could be detected and traced or jammed by enemy forces. For these reasons, electronic listening devices have not gained widespread use throughout the military.

OBJECTS AND SUMMARY OF THE INVENTION

The primary object of this invention is to provide a listening device that is non-electronic with no internal noise thus having greater sensitivity than an electronic device. This will allow detection of audible sound waves at a greater distance.

An additional object of this invention is to provide a hand-held, manually powered, non-electronic, non-emitting listening device that is highly directive and insensitive to electromagnetic interference (EMI).

The present invention uses acoustic and fluidic technologies in combination to amplify sound waves in the audible range of 0 to around 4,000 Hz, which includes the spectrum of human speech. Sound waves are gathered and focused by a parabolic dish antenna which provides the first stage of non-electronic amplification and directivity. An exponential horn is placed at the focal point of the parabolic dish and provides the second stage of non-electronic amplification. The exponential horn is connected to a fluidic gainblock in which staged laminar proportional amplifiers provide the final stage of non-electronic amplification. Fluid for the operation of the gainblock is supplied by a pressurized fluid container through a pressure regulator. The fluid container is pressurized either by pumping a latex bulb or by a mechanical pump. Although ambient air is the most practical fluid medium to use, other fluid mediums are possible, such as pressurized gases or liquids. The output of the gainblock is fed either into a pair of acoustic earphones, similar to those used on airlines. An alternate embodiment has a microphone and an electronic amplifier located at the output of the gainblock, which further increases the sensitivity of the system and allows recording capabilities. The entire system provides a total acoustic amplification of around 60–70 dB. Because the system is fluidically based, it does not require signal processing electronics (with associated batteries) and therefore is lightweight, rugged, and highly mobile. The system has a range of about 250 meters for conversational speech depending upon the terrain, humidity and other enviromental operating constraints. In comparison to an electronically based system, the present invention has the advantage of a negligible noise floor. As a consequence, the sensitivity of the present invention is superior to currently available electronic-acoustic listening systems.

DETAILED DESCRIPTION OF THE PREFERRED EMBODIMENTS

Figure 1:
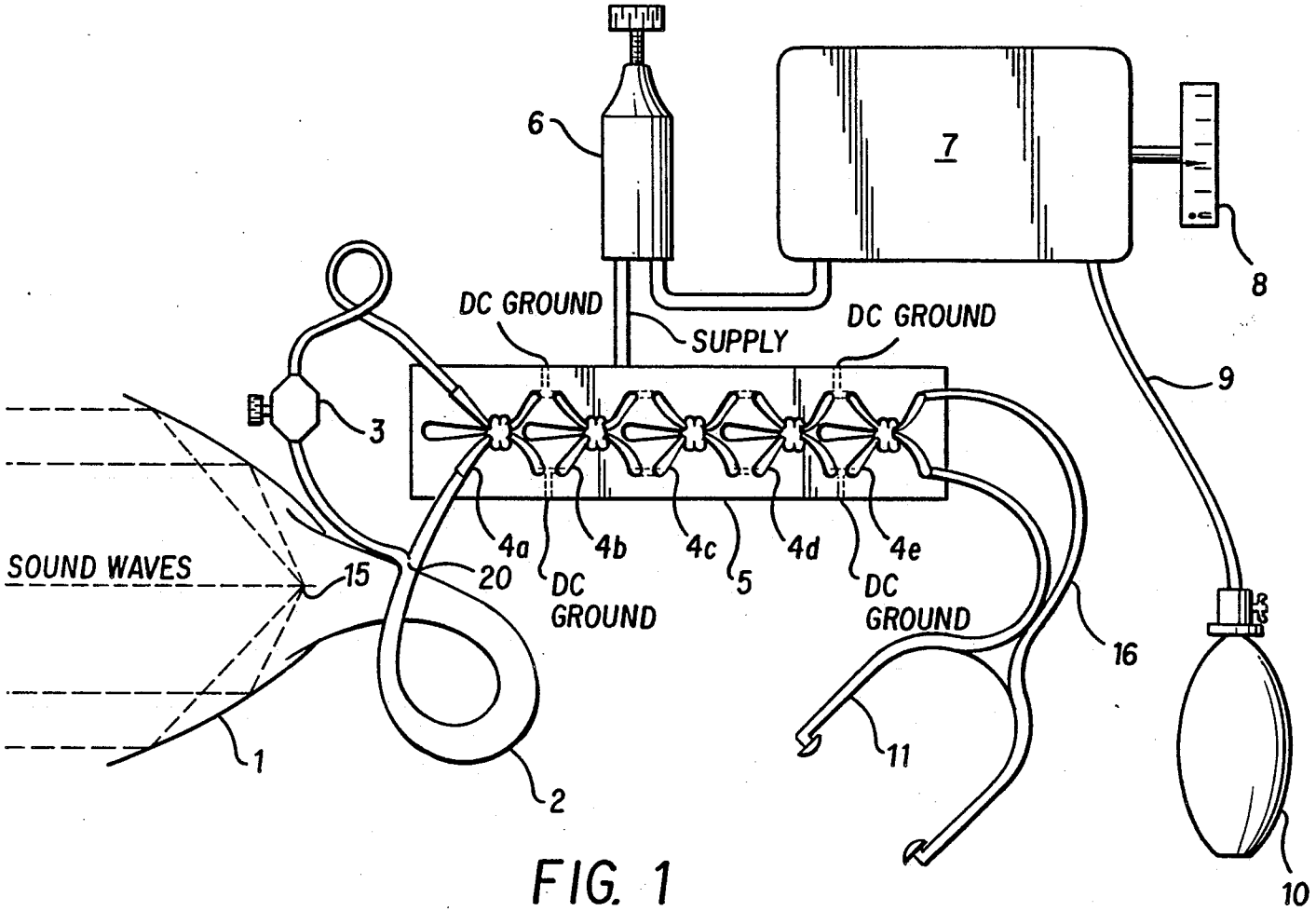
FIG. 1 is a schematic depiction of the components of the present invention.

Referring now to FIG. 1, the components of the present invention are shown. Travelling sound waves enter parabolic dish antenna 1 and are focused at focal point 15 of parabolic dish antenna 1. In one embodiment tested, parabolic dish antenna 1 had a diameter of 9 inches, a depth of 7 inches, and a focal point 15 at 0.75 inches from the vertex. Parabolic dish antenna 1 is highly directive and will provide an initial amplification of the sound waves by about 10 dB.

A second stage of amplification is provided by exponential horn 2, which is placed at focal point 15 of parabolic dish antenna 1. In an exponential horn, the cross-sectional area $Sx$ at any distance $x$ from the throat is given by the equation:

$$Sx = Soe^{mx}$$

where $So$ is the throat area and m is the flare constant. While the use of exponential horn 2 is not essential to the functioning of the present invention, it's presence is highly desirable as exponential horn 2 will result in a marked increase in acoustic input at high frequencies. At low frequencies, the effect of exponential horn is almost negligible, and the roll-off frequency $fc$ can be predicted by the following equation:

$$fc = mc/4\pi$$

where $c$ is the speed of sound. Exponential horn 2 is omnidirectional, and provides an additional amplification of about 20 dB without any internal system noise. The combination of parabolic dish antenna 1 and exponential horn 2 will therefore provide a total AC gain of about 30 dB in the audio range.

The sound waves gathered by parabolic dish antenna 1 and exponential horn 2 will travel down the interior void of exponential horn 2 and split into two channels at junction 20, where one channel is fed directly to one input of fluidic gainblock 5, and the other channel is fed to the second input of gainblock 5 through equalizing valve 3, which is used to balance the input signals between the control inputs of first laminar fluidic amplifier 4a. By splitting the signal in the above fashion, the effect of wind on the system is eliminated due to the common mode rejection by the fluidic amplifier. Interestingly enough, the looping shown in FIG. 1 of exponential horn 2 from focal point 15 to junction 20 has little or no effect on the performance of exponential horn 2, i.e., exponential horn 2 can be straight, as in a loudspeaker, or can be looped, as shown in FIG. 1, with no ill effects to the operation of the system.

Fluidic gainblock 5 consists of a number of laminar proportional amplifiers 4a–4e, each of which exhibit a pressure gain of about 10, and have a bandwidth of 0 to 4,000 Hz. Laminar proportional amplifiers 4a–4e utilizing fluids (air or other gases or liquids) as their power supply are well known in the art, thus a detailed discussion of the principals of amplification by fluidic amplifiers is not necessary here. As is well known in the art, by stacking thin wafers or laminates, a fluidic gainblock 5 can be fabricated with any number of laminar proportional amplifiers. In one embodiment tested, a total of 4 laminar proportional amplifiers was used successfully, but 4 is by no means a minimum, optimum, or maximum amount. More or less than 4 laminar proportional amplifiers may be used depending upon the particular application. The laminar proportional amplifiers are staged within fluidic gainblock 5 by connecting the output of the first stage to the input of the second stage, thereby multiplying the gain of the first stage by 10. Additional stages can be added as needed, as each new stage will increase the overall gain by a factor of 5 to 10. In the AC mode, where the input pressure is an acoustic signal, gain is measured in dB. The typical gain for a fluidic gainblock is about 50 dB for a four-stage amplifier.

Power for the operation of fluidic gainblock 5 is provided by fluid storage container 7. In one embodiment tested, a plastic bottle was used as fluid storage container 7. Fluid storage container 7 is pressurized by pumping latex bulb 10, which supplies pressurized fluid (air) to container 7 through hose 9. Latex bulb 10 is of the type commonly found on blood pressure measurement devices. Pressurized fluid from container 7 then flows through pressure regulator 6, which regulates the fluid supply pressure to gainblock 5 at the correct setting. Regulator 6 can be fixed or variable depending upon the particular application. Pressure gage 8 gives a visual indication of the pressure in container 7 and indicates when there is a need to pump latex bulb 10 for additional pressurized fluid. In one embodiment tested, when container 7 was pressurized with air to about 10 psi, gainblock 5 would operate for about 30 seconds. As an alternative to using latex bulb 10, a small mechanical fluid pump 30 shown in FIG. 2 could be used thus eliminating the necessity to pump latex bulb 10. This modification would also necessitate the expense and weight of adding a battery or other electrical power for the mechanical fluid pump. It would also be possible to use a pre-pressurized container 32 to supply gainblock 5. The pre-pressurized container could be replaceable, or the entire listening device could be expendable.

Figure 2:
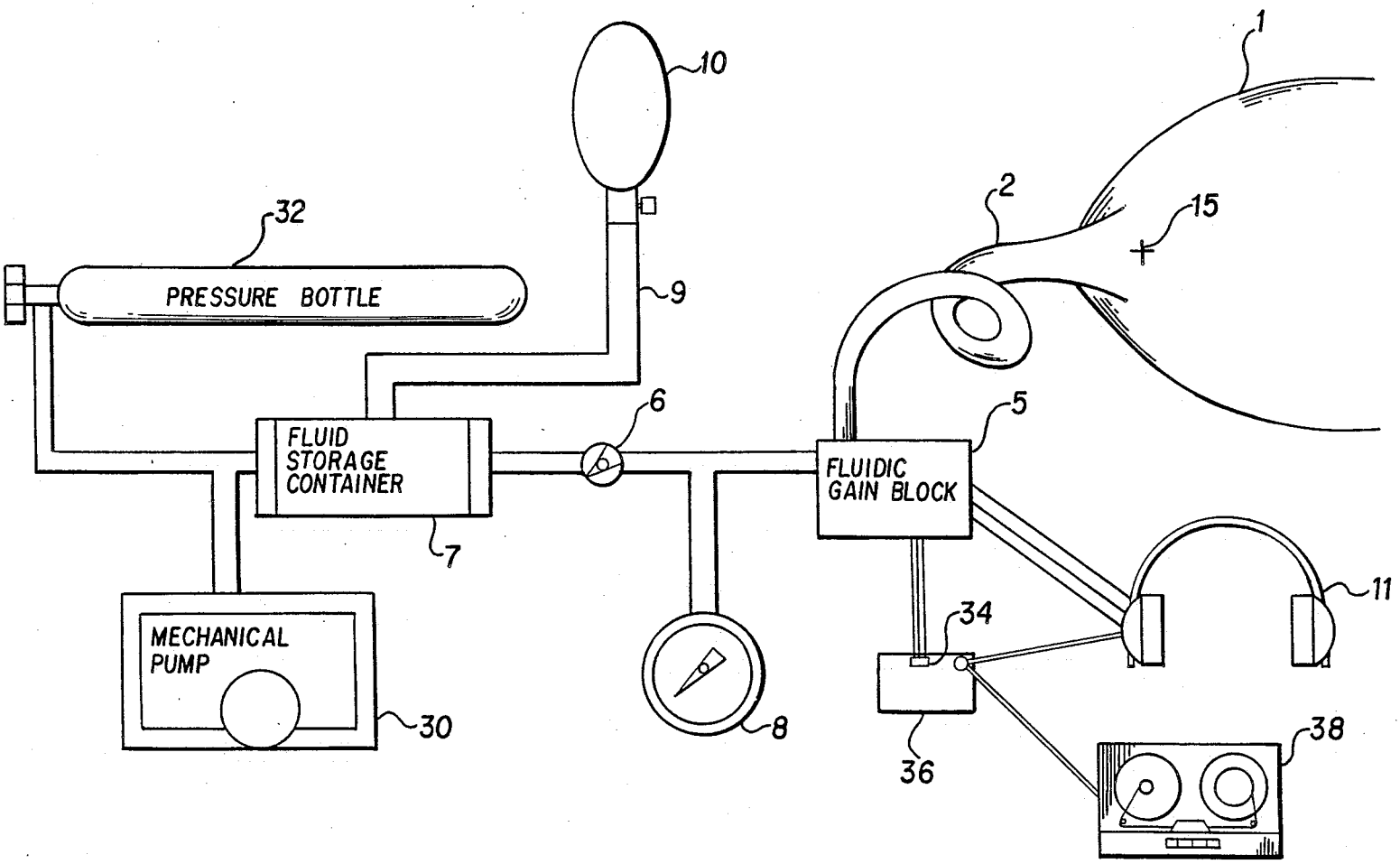
FIG. 2 is a schematic depiction showing alternate components of the present invention.

The output of fluidic gainblock 5 is fed through output lines 16 to acoustic earphones 11. Acoustic earphones 11 are of the type commonly found on passenger airlines. As shown in FIG. 2 if additional amplification is desired, electronic amplification, such as a microphone 34 and amplifier 36, could be placed at the output of fluidic gainblock 5, in which case gainblock 5 then acts as a pre-amplifier. Gainblock 5 would then amplify low-level signals, above the threshold of the microphone. In addition to or in place of acoustic earphones 11, a voice-activated recorder 38 could be used to record and listen to signals simultaneously. Electronic filtering could then be used to further enhance the device.

Normal filtering is provided in fluidic gainblock 5 by providing several DC grounds thus reducing some low frequency background noise. The nature of the fluidic amplifier along with the DC grounds serve as a high-amplitude cut-off. When the input signal is large (i.e. blast or shout), the fluidic jet travelling through gainblock 5 is grounded to atmosphere by saturating the fluidics and through multiple DC grounds, thereby protecting the user's ears or sensitive microphones. Additional filtering is possible by providing an orifice in output lines 16 or along exponential horn 2.

The components described above can be packaged as desired for the intended application. For example, the components can be packaged in a "megaphone" configuration, with latex bulb 10 and acoustic earphones 11 external, thus allowing the device to be hand-held and easily transportable. This method of packaging is particularly desirable for a light-weight "eavesdropping" unit for use by the military. In this type of configuration, the operator can detect conversational speech at a range of about 250 meters. To those skilled in the art, many modifications and variations of the present invention are possible in light of the above teachings. It is therefore to be understood that the present invention can be practiced otherwise than as specifically described herein and still will be within the spirit and scope of the appended claims.

We claim:

1. A portable acoustic detection device for detecting low amplitude acoustic waves in the range of 0 to 4,000 Hz comprising:
   - a deep parabolic dish antenna having a focal point within the concave portion of said dish;
   - a fluidic amplifying means having a high amplitude cut-off to amplify said low amplitude acoustic waves;
   - acoustic amplifying means connected between said parabolic dish and said fluidic amplifying means;
   - listening means connected to said fluidic amplifying means; wherein said fluidic amplifying means comprises a fluidic gainblock having a plurality of staged laminar proportional amplifiers and fluid supply means for said gainblock; wherein said fluid supply mean comprises a fluid storage container and a pressure regulator and a hand powered pump means for pressurizing said fluid storage container.

2. The device of claim 1 wherein said deep parabolic dish antenna has a diameter of 9 inches, a depth of 7 inches, and a focal point of 0.75 inches.

3. The device of claim 2 wherein said parabolic dish antenna has a gain of 10 dB.

4. The device of claim 1 wherein said acoustic amplifying means is an exponential horn.

5. The device of claim 4 wherein said exponential horn has a gain of 20 dB.

6. The device of claim 1 further comprising a pressure gage connected to said fluid storage container.

7. The device of claim 1 wherein said fluid storage container is a plastic bottle.

8. The device of claim 1 wherein said means for pressurizing said fluid storage container is a latex bulb.

9. The device of claim 1 wherein said listening means is acoustic earphones.

10. The device of claim 1 wherein said listening means is a sound activated recorder.

11. The device of claim 1 wherein said listening device is a sound activated recorder and acoustic earphones.

12. The device of claim 1 wherein said plurality of staged laminar proportional amplifiers consists of 4 laminar proportional amplifiers.

13. The device of claim 12 wherein said laminar proportional amplifiers have a bandwidth of 0 to 4,000 Hz.

14. The device of claim 1 wherein said fluidic gainblock has a gain of 50 dB.

15. The device of claim 1 further comprising electronic amplification means at the output of said fluidic gainblock.

16. The device of claim 15 wherein said electronic amplification means is a microphone and an electronic amplifier.

17. The device of claim 1 wherein said fluidic gainblock operates as a preamplifier to amplify low-level acoustic signals above the electronic noise level threshold of conventional microphones.

* * * * *